US006843284B2

(12) United States Patent
Morin

(10) Patent No.: US 6,843,284 B2
(45) Date of Patent: Jan. 18, 2005

(54) CROOK FOR FILLING A SANDBOX

(75) Inventor: Jack Morin, Paoli, PA (US)

(73) Assignee: NEU International, Marq en Baroeul (FR)

( * ) Notice: Subject to any disclaimer, the term of this patent is extended or adjusted under 35 U.S.C. 154(b) by 0 days.

(21) Appl. No.: 10/460,864

(22) Filed: Jun. 13, 2003

(65) Prior Publication Data

US 2004/0250872 A1 Dec. 16, 2004

(51) Int. Cl.[7] ..... B65B 1/04

(52) U.S. Cl. ..... 141/59; 141/67; 141/286; 409/98

(58) Field of Search ..... 141/59, 392, 388, 141/389, 231, 98; 222/394, 399, 527, 481.5, 630, 637; 409/98, 102, 109, 130, 192

(56) References Cited

U.S. PATENT DOCUMENTS 1,340,606 A * 5/1920 Groenewold ..... 406/98
1,865,145 A * 6/1932 Seidemann ..... 406/93
6,176,279 B1 * 1/2001 Dahlin et al. ..... 141/231
6,382,272 B1 * 5/2002 Dahlin et al. ..... 141/231
6,666,642 B2 * 12/2003 Fourcroy ..... 414/339

FOREIGN PATENT DOCUMENTS

DE 2 443 552 A 3/1976
EP 0 561 679 B1 11/1995

* cited by examiner

*Primary Examiner*—Steven O. Douglas
(74) *Attorney, Agent, or Firm*—Weingarten, Schurgin, Gagnebin & Lebovici LLP

(57) ABSTRACT

A sandbox filler crook comprising a feed pipe in which a granular material is transported by compressed air, which pipe presents successively an upstream portion for holding by an operator, a curved intermediate portion, and a downstream portion for insertion into a feed orifice of the sandbox, the upstream and downstream portions being rectilinear and substantially vertical during filling, wherein said downstream portion of the pipe includes at least one side orifice for air exhaust.

11 Claims, 3 Drawing Sheets

CROOK FOR FILLING A SANDBOX

The present invention relates to an operator delivering a granular material such as sand from a fixed position to fill tanks, commonly referred to as "sandboxes", which are provided in rail vehicles, where that term covers not only trains but also trams. The invention relates more particularly to portable dispensing equipment referred to as a sandbox filler crook.

BACKGROUND OF THE INVENTION

In rail vehicles, it is known to deliver sand between the wheels and the rail in order to increase the adhesion of the wheel on the rail. This is done when the vehicle starts and on each occasion it is necessary to transit a high level of torque, with the sand being taken from a storage tank referred to as a "sandbox". The sandbox is itself filled while the vehicle is stationary, in particular when it is beside a platform. The sandbox has a feed inlet orifice which is accessible from outside the vehicle.

In general, sandboxes are filled from a sand storage vessel connected to a feed pipe. The storage vessel is placed at a height that is sufficient to allow sand to flow under gravity into the pipe and then into the inlet orifice of the sandbox. In order to increase the rate at which sand flows, the storage vessel may be pressurized.

Proposals have already been made, in particular in documents DE 2 443 552 and EP 0 561 679 for devices for dispensing a granular material, which devices comprise at least one material transfer vessel fed with compressed air under pressure, and at least one portable dispenser head having one end connected by a flexible pipe to the transfer vessel. The pressure and flow rate conditions of the compressed air in the transfer vessel are determined so as to obtain a flow of material in the pipe.

The devices proposed by those prior documents are suitable for filling sandboxes when the inlet orifice is at man height, i.e. at a height that is low enough down for an operator on the platform to be able manually to insert the portable head into the inlet orifice of the sandbox. Such devices are suitable in particular for the European rail network.

In contrast, those devices are unsuitable for certain rail networks, in particular in North and South America, where rail vehicles are much taller and have large-capacity sandboxes with inlet orifices located near the top of the vehicle, i.e. orifices that are not directly accessible for an operator on the platform. Such sandboxes are filled, in known manner, with the help of a portable dispenser head having a shepherd's crook configuration, and can thus be referred to as a filler crook. It presents a rectilinear portion which is held by the operator, with said rectilinear portion being extended by a top curved portion that comes over the top of the vehicle, said curved portion itself being extended by an end portion for insertion into the inlet orifice of the sandbox.

As in the devices known in particular from documents DE 2 443 552 and EP 0 561 679, the granular material moves along the feed pipe of the filler crook because of the action of compressed air.

Given the special shape of the filler crook, it is not without some difficulty that the granular material is made to move under pressure. One difficulty consists in pockets of air forming in the feed pipe, where said pockets of air give rise to jolting in the crook while granular material is escaping through the open end of the pipe. These jolts travel along the entire length of the crook and can hinder or even injure the operator. Another drawback lies in the difficulty of passing granular material round the curved portion of the filler crook, where the curved passage can give rise to the granular material slowing down or even becoming blocked, which prevents the filler crook from operating properly. This drawback becomes more marked as the sandbox fills up and the volume of air that remains in said sandbox decreases. That explains why the pressure inside the sandbox rises. Consequently, the transport pressure increases, and transport becomes jerkier, so that granular material and dust can escape.

OBJECT AND SUMMARY OF THE INVENTION

The object of the present invention is to enable a sandbox whose inlet orifice is in the top of the vehicle to be filled by means of a filler crook which does not present the above-mentioned drawbacks.

This object is achieved by the filler crook of the invention which, in known manner, comprises a feed pipe in which a granular material is transported by compressed air, which pipe presents successively an upstream portion for holding by an operator, a curved intermediate portion, and a downstream portion for insertion into a feed orifice of the sandbox, the upstream and downstream portions being rectilinear and substantially vertical during filling.

In a manner characteristic of the present invention, said downstream portion of the pipe includes at least one side orifice for air exhaust.

Thus, by means of this particular disposition, pockets of compressed air which travel together with the granular material in the pipe are at a pressure which decreases prior to reaching the open end of the pipe, thereby diminishing or even totally avoiding the previously observed jolting.

In a variant embodiment, the downstream portion of the pipe has an outer protective cover forming a chamber for evacuating the air and having the side orifice opening out therein, which cover is open to allow the air to be evacuated into the sandbox during filling. The presence of this outer protective cover enables the dust ejected through the side hole as a pocket of air goes past to be directed towards the inside of the sandbox.

In a variant embodiment, the inside diameter of the pipe in its downstream portion is greater than the inside diameter of the pipe in its upstream portion and in its curved portion. This has the effect of ensuring a certain amount of decompression and a certain amount of decompacting of the granular material in the downstream portion, thereby making it easier to deliver the granular material from the pipe.

In which case, and preferably, the downstream half of the curved portion of the pipe has an inside diameter greater than its inside diameter in its upstream half, said diameter being equal to that of the upstream portion of the pipe. The change in inside diameter between the upstream half and the downstream half of the curved portion occurs beyond the part of the pipe that is at the top when the pipe is in the filling position. It is thus at this level that the desired decompression and decompacting take place, and the effect thereof combines with the natural action of gravity on the sand so as to eliminate the sand properly from the downstream half of the curved portion and from the downstream portion of the pipe.

Preferably, the feed pipe is constituted by a plurality of lengths of tube having different diameters, suitable for being engaged one in another.

In addition, a cover sheet covers two successive lengths of tube level with and on either side of the engagement zone, in particular in the form of a heat-shrink sheath. This provides a pipe that appears to be a single piece even though it is built up along its length from a plurality of tubes of different diameters.

In a variant embodiment, the feed pipe is flexible and the filler crook includes a suction pipe which is rigid.

BRIEF DESCRIPTION OF THE DRAWINGS

The present invention will be better understood on reading the following description of an embodiment of a filler crook illustrated in the accompanying drawings, in which.

MORE DETAILED DESCRIPTION

Figure 4:
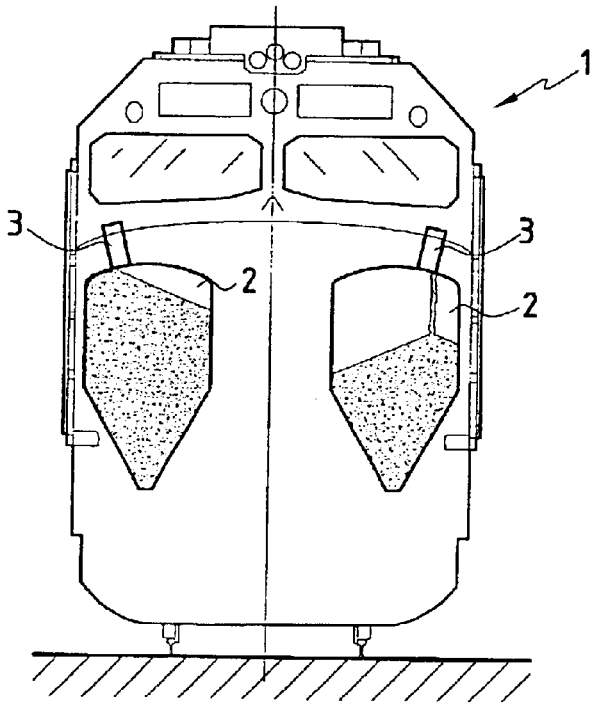
FIG. 4 is a diagrammatic view of a North American rail vehicle having two sandboxes.

In traditional manner, as shown in FIG. 4, in a North American rail vehicle 1, each large-capacity sandbox 2 has an inlet orifice 3 situated at the top of the sandbox 2 and opening to the outside of the vehicle 1 at a height which is well above the height of a man on the platform 4. An operator standing on the platform 4 fills the sandbox 2 by means of a portable head of a sand dispenser unit, which head is referred to as a filler crook 5 by analogy with the general shape of a shepherd's crook having a curved end.

The filler crook 5 is connected by a flexible pipe 9 to a transfer vessel which is fed with compressed air under pressure, forming part of the stationary sand distribution unit which is itself standing on the platform 4. A sand storage silo possibly feeds a plurality of storage vessels disposed beneath platform level, each storage vessel itself being connected to and feeding a plurality of transfer vessels.

Figure 1:
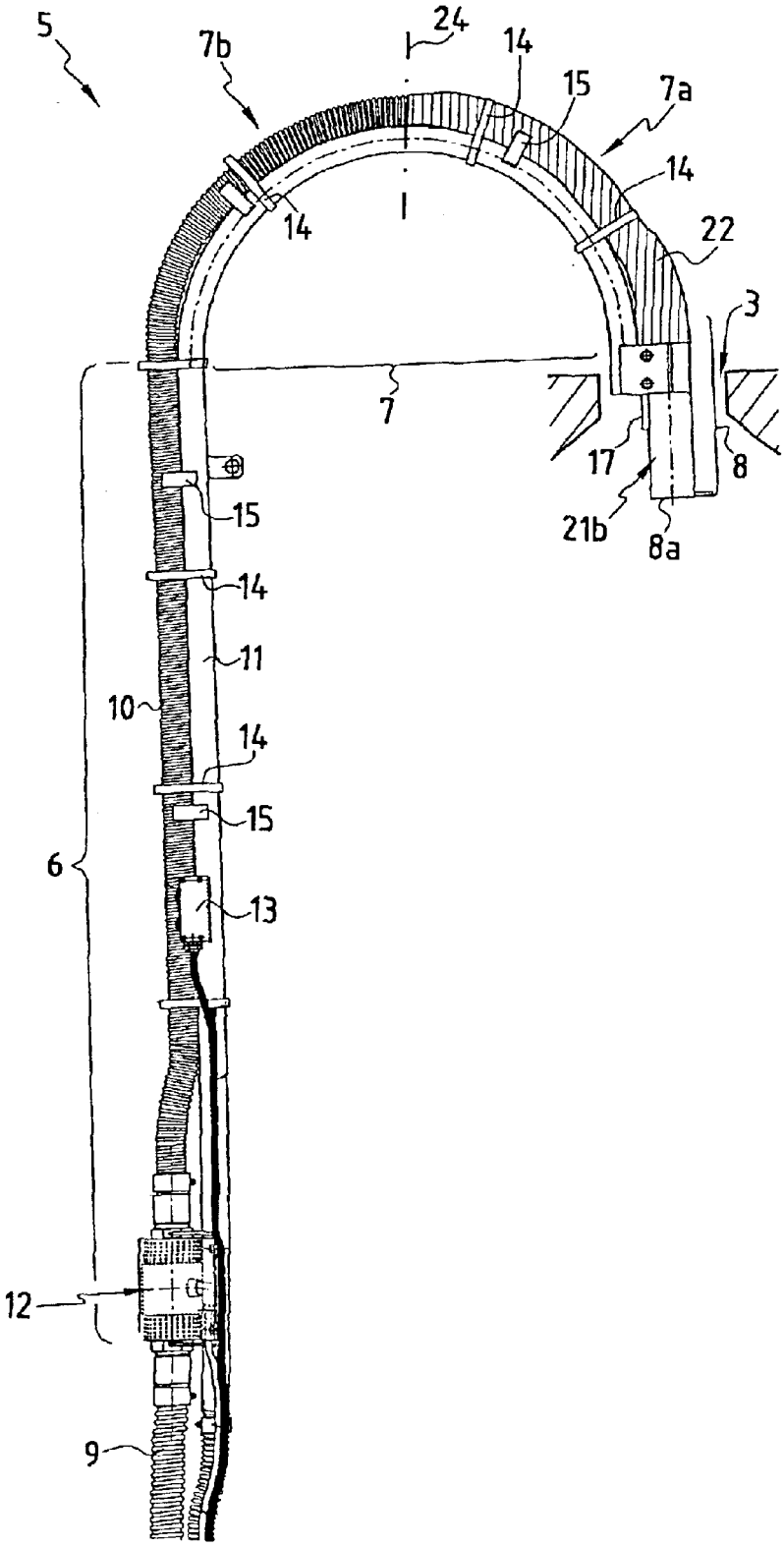
FIG. 1 is a diagrammatic side view of the filler crook.

As shown in FIG. 1, the filler crook 5 has running substantially along its entire length two pipes: a feed pipe 10 which pneumatically transports sand; and a suction pipe 11 whose function is to suck up the dust that escapes from the sandbox during filling.

In the example shown, the suction pipe 11 is constituted by a rigid or semi-rigid tube, in particular a tube made of reinforced plastics material, which serves as a support for the feed pipe 10, which itself is constituted by a flexible pipe or hose. The feed pipe is preferably made of a plastics material that is transparent or translucent so as to allow the operator to see whether sand is present or absent in the filler crook 5, and also to see how fast it is moving.

The filler crook 5 comprises three successive portions: an upstream first portion 6 which is rectilinear and which constitutes the part of the filler crook 5 that is held by the operator on the platform 4; a curved second portion 7; and a downstream third portion of short length, which third portion is rectilinear and serves to insert the filler crook 5 into the inlet orifice 3 of the sandbox 2.

The length of the upstream portion 6, the shape of the curved second portion 7, and the shape of the downstream portion 8 are determined as a function of rail vehicle type, in particular as a function of the height of the inlet orifice 3 of the sandbox above the level of the platform 4 and the distance between said inlet orifice 3 and the position an operator can take up on the platform 4 when standing next to the rail vehicle 1. It will be understood that it must be possible for the operator, without significant difficulty, to take hold of the crook by its upstream portion 6 and to cause its downstream portion 8 to penetrate into the inlet orifice 3 of the sandbox.

The filler crook 5 is connected to the flexible pipe 9 bringing sand from the transfer vessel via an automatic valve 12. In addition an on/off control 13 is fixed on the upstream portion 6 of the filler crook 5 at a position that is accessible to the operator.

The flexible feed pipe 10 is held in position on the rigid suction pipe 11 by lateral abutments 15 mounted on the suction pipe 11, and it is fixed thereto by fixing collars 14 clamped around both pipes 10 and 11.

For filling purposes, the pressure and flow rate conditions of the compressed air in the transfer vessel, the dimensions of the flexible pipe 9, and the dimensions of the feed pipe 10 feeding the filler crook 5 are all determined so as to ensure that the material is transported to the end 8*a* of the downstream portion 8 of the filler crook 5 with a flow that generally corresponds to transport in a dense phase, or better in a solid phase. However, regardless of the precautions that are taken, it is found in practice that the material does not flow continuously, because pockets of air are created in the feed pipe 10 and they travel together with the material, the air in said pockets being under pressure. When an air pocket reaches the end 8*a* of the downstream portion 8 of the filler crook 5, it expands, and this expansion is transformed into a severe jolt that runs along the entire filler crook 5 to the operator. This jolt can lead to accidents and can even cause the filler crook to be expelled from the inlet orifice 3.

To mitigate this drawback, in accordance with the present invention the feed pipe 10 situated in the downstream portion 8 of the filler crook 5 has at least one side orifice 16 for air exhaust. In the example shown in FIG. 2, there are two side orifices 16.

Thus, before reaching the end 8*a* of the downstream portion 8 of the filler crook, the air under pressure contained in the air pocket can escape through the side orifices 16. Its pressure is thus decreased progressively, thereby avoiding the jolts observed in the past.

Each side orifice 16 is preferably of a diameter smaller than 10 millimeters (mm), e.g. a diameter of 6 mm.

The escape of air through the side orifices 16 is necessarily accompanied by dust being blown out. In order to prevent this outflow of dust being deposited outside the sandbox 2, a cover 17 covers the outside of the downstream portion 8 of the feed pipe 10 in the vicinity of the side orifices 16. This cover is made in such a manner as to form an air exhaust chamber 18, which chamber 18 has an opening 18*a* facing towards the end 8*a* of the downstream portion 8. This opening 18*a* thus leads into the sandbox 2 when the downstream portion 8 of the filler crook 5 is inserted into the inlet orifice 3 of the sandbox 2. As a result, the air together with the dust entrained thereby escaping from the side orifices 16 is injected into the sandbox 2, and said dust is possibly subsequently taken up by the suction pipe 11.

Furthermore, along its length, the feed pipe 10 has changes in its inside diameter. More precisely, the diameter D1 in the downstream portion 8 is greater than the diameter D2 in the downstream second half 7*a* of the curved portion 7, said diameter D2 itself being greater than the diameter D3 in the upstream portion 6 and in the upstream first half 7*b* of the curved portion 7.

Figure 2:
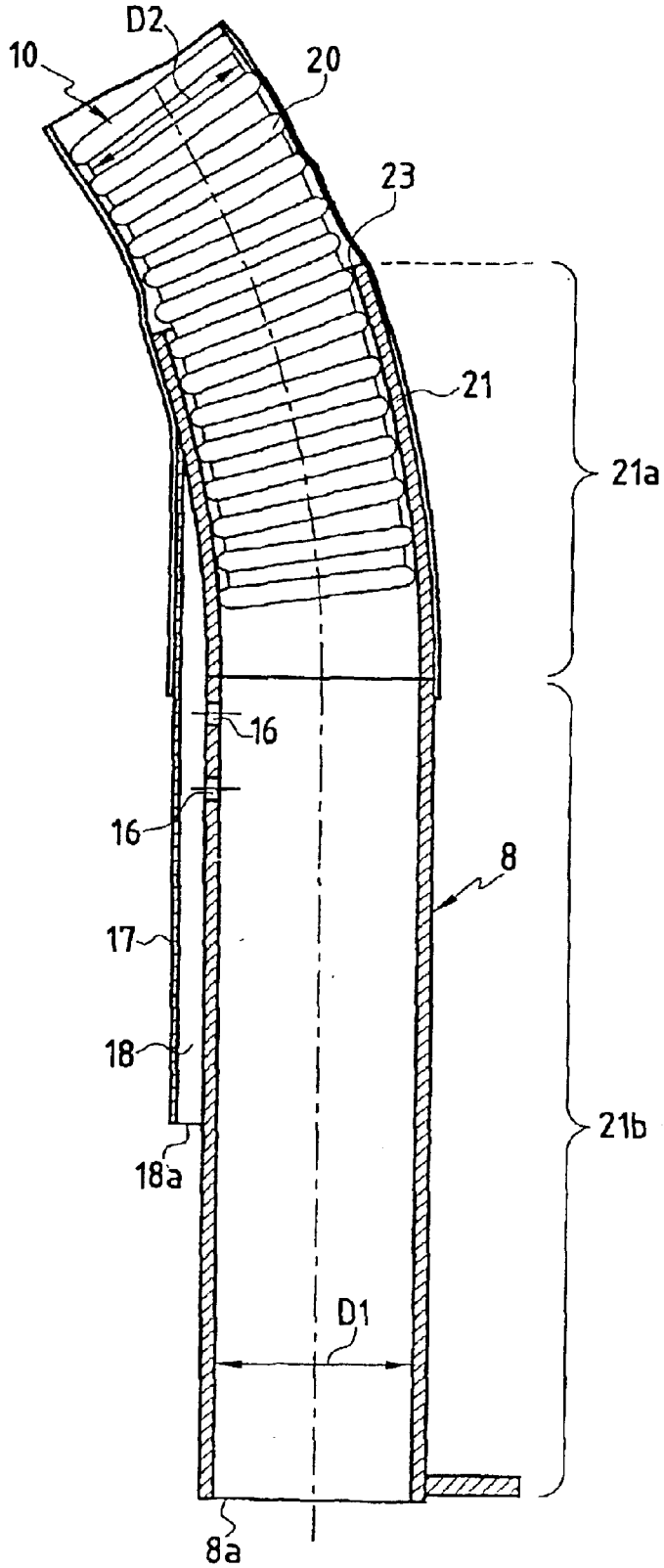
FIG. 2 is a diagrammatic longitudinal section of the downstream portion of the FIG. 1 filler crook.
Figure 3:
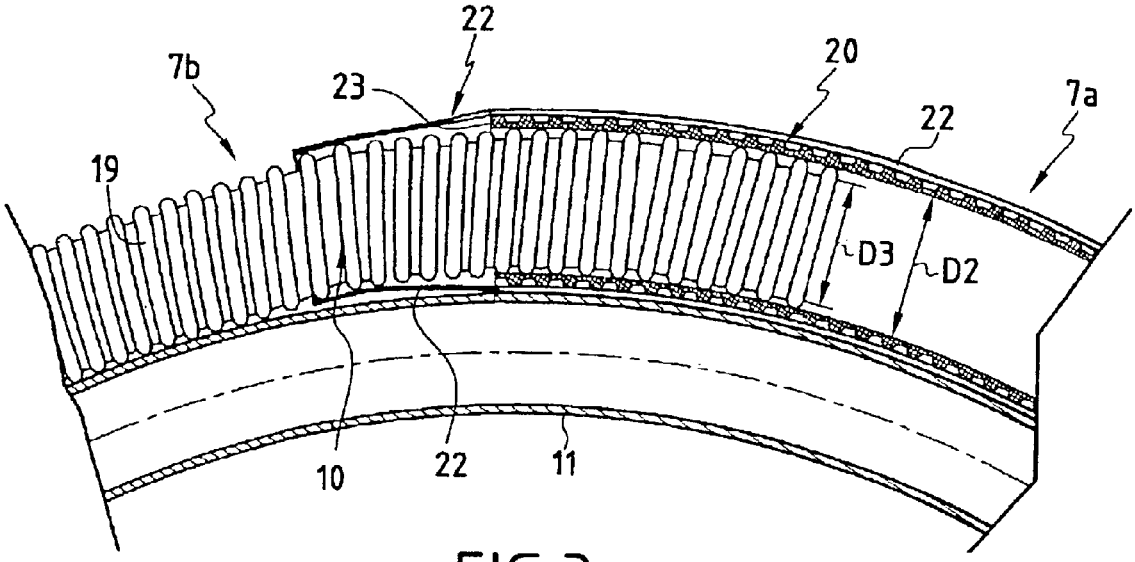
FIG. 3 is a fragmentary diagram in longitudinal section of the FIG. 1 filler crook where the diameter of the feed pipe changes.

A change of diameter can be seen in FIGS. 2 and 3. In the example shown, this change in diameter is obtained by using two distinct lengths of tube that are suitable for engaging one in another. The first length of tube 19 furthest upstream has an inside diameter D3 and an outside configuration enabling it to engage in the second length of tube of inside diameter D2 which is likewise a segment of flexible pipe. This second length of tube 20 also has an outside configuration enabling it to become engaged in the third length of tube 21 of inside diameter D1 which is preferably made of rigid tube and which has a proximal portion 21*a* that is slightly curved forming a fraction of the curved portion 7 of the filler crook 5, while the distal portion 21*b* of the hollow tube 21 constitutes the downstream portion 8 of the filler crook 5.

In order to hide the extra thicknesses 23 due to the changes in the diameter of the feed pipe 10, a covering sheet 22 covers said pipe 10 over a zone which extends at least from one end to the other of said extra thicknesses 23. In the example shown, the covering sheet 22 also extends over the entire length of the second length of tube 20 of inside diameter D2, substantially to the front end of the curved portion 7 of the filler crook 5. This covering sheet may be constituted in particular by a heat-shrink sheath.

During filling, the increase in diameter on going from the first length of tube 19 of diameter D3 to the second length of tube 20 of the diameter D2 leads to decompression occurring inside the feed pipe 10, which decompression leads to the material which is being transported in said pipe 10 being decompacted. The same applies on going from the second length of tube 20 of diameter D2 to the third length of tube 21 of diameter D1. It should also be observed that the change in diameter takes place beyond the midplane 24 of the curved portion 7 of the filler crook 5, which plane 24 corresponds substantially to a vertical plane when filling is taking place. Beyond the midplane 24, the material which is transported in the feed pipe 10 is then subjected to the natural action of gravity. This action in combination with the decompression in said pipe 10 facilitates delivering the material. In addition, this decompression compensates for the increase in pressure that takes place inside the sandbox towards the end of filling when the volume of air available inside the sandbox has become small.

The increase in the diameter of the feed pipe 10 beyond the midplane 24 of the curved portion 7 also contributes to reducing the jolts that are observed with a filler crook during pneumatic transport of material inside the feed pipe 10. It therefore contributes to the comfort and the safety of the operator.

In a particular embodiment, given by way of non-exhaustive example, the diameter D3 of the first length of tube was 40 mm, the diameter D2 of the second length of tube was 45 mm, and the diameter D1 of the third length of tube was 53 mm.

What is claimed is:

1. A sandbox filler crook comprising a feed pipe in which a granular material is transported by compressed air with a flow that corresponds to transport in a dense phase or in a solid phase, which pipe presents successively an upstream portion for holding by an operator, a curved intermediate portion, and a downstream portion for insertion into a feed orifice of the sandbox, the upstream and downstream portions being rectilinear and substantially vertical during filling, wherein said downstream portion of the pipe includes at least one side orifice for air exhaust, the at least one side orifice being through a rectilinear side wall of the downstream portion.

2. A filler crook according to claim 1, wherein the air exhaust side orifice has a diameter of less than 10 mm.

3. A filler crook according to claim 2, wherein the air exhaust side orifice has a diameter of about 6 mm.

4. A filler crook according to claim 2, wherein the downstream portion of the pipe has two side orifices.

5. A filler crook according to claim 1, wherein the downstream portion of the pipe has an outer protective cover forming a chamber for evacuating the air and having the side orifice opening out therein, which cover is open to allow the air to be evacuated into the sandbox during filling.

6. A filler crook according to claim 1, wherein the inside diameter of the pipe in its downstream portion is greater than the inside diameter of the pipe in its upstream portion and in the curved portion.

7. A filler crook according to claim 6, wherein the curved portion of the pipe, in its downstream half, has an inside diameter greater than the inside diameter it has in its upstream half, said diameter being equal to the diameter of the upstream portion of the pipe, the change in inside diameter occurring beyond the median axis of the curved portion.

8. A filler crook according to claim 6, wherein the feed pipe is constituted by a plurality of lengths of tube having different diameters, suitable for being engaged one in another.

9. A filler crook according to claim 8, including a covering sheet covering two successive lengths of tube over and on either side of an engagement zone between said two lengths of tube.

10. A filler crook according to claim 9, wherein the covering sheet is a heat-shrink sheath.

11. A filler crook according to claim 1, wherein the feed pipe is flexible, the filler crook including a suction pipe that is rigid and that serves as a support for the feed pipe.

* * * * *